US007707796B2

(12) United States Patent
Arias

(10) Patent No.: US 7,707,796 B2
(45) Date of Patent: May 4, 2010

(54) CURTAIN WALL SYSTEM AND METHOD

(75) Inventor: Augusto Arias, Le Gardeur (CA)

(73) Assignee: Muridal, Inc., Le Gardeur (CA)

( * ) Notice: Subject to any disclaimer, the term of this patent is extended or adjusted under 35 U.S.C. 154(b) by 0 days.

(21) Appl. No.: 11/986,918

(22) Filed: Nov. 26, 2007

(65) Prior Publication Data

US 2008/0072532 A1 Mar. 27, 2008

Related U.S. Application Data

(62) Division of application No. 11/081,328, filed on Mar. 15, 2005.

(51) Int. Cl.
*E04B 2/88* (2006.01)
*E04B 2/90* (2006.01)

(52) U.S. Cl. ..... 52/745.09; 52/745.06; 52/745.1; 52/745.15; 52/745.16; 52/235

(58) Field of Classification Search ..... 52/745.05, 52/745.06, 745.09, 745.1, 745.11, 745.13, 52/235, 745.15, 745.16, 489.2, 769, 772, 52/762; 292/302, 175, 146, 33, 42, 145, 292/163, 165, 170, 166
See application file for complete search history.

(56) References Cited

U.S. PATENT DOCUMENTS 5,067,300 A * 11/1991 Takeda ..... 52/745.1
5,323,577 A * 6/1994 Whitmyer ..... 52/235
5,644,878 A * 7/1997 Wehrmann ..... 52/287.1

FOREIGN PATENT DOCUMENTS

JP 6-322866 * 11/1994 ..... 52/235

* cited by examiner

*Primary Examiner*—Phi Dieu Tran A
(74) *Attorney, Agent, or Firm*—Carter Schnedler & Monteith, P.A.

(57) ABSTRACT

A connector device is provided for a curtain wall system of the type having structural members secured to the building framing to define frames to support glazing panels. The glazing panels each have a sash by which they are secured to the frames of structural members to form an outer wall portion of a building. The curtain wall system has connector devices securing one of the glazing panels to the frames of structural members. The connector device comprises a keeper secured to a frame, and a latch mechanism secured opposite the keeper on the sash. The latch mechanism has a latch bolt automatically displaceable to a locking position upon contact with the keeper. The keeper and the latch mechanism cooperate in the locking position to lock the glazing panel to the frame in a secured position. A method for installing the connector device is also provided.

4 Claims, 6 Drawing Sheets

CURTAIN WALL SYSTEM AND METHOD

CROSS-REFERENCE TO RELATED APPLICATION

This patent application is a divisional of U.S. patent application Ser. No. 11/081,328, filed on Mar. 15, 2005, by the present applicant.

TECHNICAL FIELD

The present invention generally relates to curtain wall systems and, more particularly, to a connection between curtain wall panels to structural members of the curtain wall.

BACKGROUND ART

Curtain walls are widely used as exterior sheathing of buildings, especially of the commercial or institutional type. Curtain walls typically consist of glass panels defining a major portion of the exterior surface of the building, with structural members separating the glass panels. A type of curtain wall is known as VEC facade, or structural glazing, and is characterized by the absence of exposed fastener devices between adjacent glass panels, from an outer point of view. In VEC facades, a transparent/translucent panel is glued (or secured) to a sash off site to form a glazing panel, which sash will cooperate with the structural members when the glazing panel is connected to the framing.

One of the major costs associated with curtain walls is the manpower required at installation. More specifically, once the structural members (e.g., mullions and transoms) have been secured to the building framing, a substantial amount of work is required to secure the glazing panels between the structural members. The glazing panels must be precisely positioned between the structural members, and supported in position while fasteners are implanted about the periphery of a sash of the glazing panel.

In the case of VEC facades, space is limited between adjacent glass panels for esthetic considerations, thereby rendering the implanting of fasteners more difficult. The spacing between adjacent panels in VEC facades is such as to allow workers to implant the fasteners to secure the glass panels to the vertical members.

The amount of work and time required to install curtain walls is substantial, and is associated with other problems pertaining to the logistics of construction sites. For instance, the amount of time required is often in the order of several days, thereby potentially exposing the construction sites to problematic weather conditions, such as rain and wind. This may cause delays in scheduling on the construction site. Moreover, the amount of time required delays the occupancy of the building.

U.S. Pat. No. 5,263,292 (hereinafter "patent '292"), issued to Holland et al. on Nov. 23, 1993, describes a building panel system in which anchor sockets are secured to the building framing. The anchor sockets are shaped so as to receive in snap-fit engagement legs of connectors secured to the glass panels. A pressure gasket is then forced into the interstitial space between the legs of adjacent panels, so as to prevent the escape of the legs from their engagement with the anchor sockets.

The building panel system of patent '292 describes a simplified installation of the glass panel to the structural members in that the glass panels are snap-fitted to the structural members without additional fasteners. However, the legs are subjected to plastic deformation when the glass panels are connected to the structural members. This requires a nonnegligible amount of force to secure the glass panels to the structural members. Also, the integrity of the connection between the glass panels and the structural members is dependent on these legs that undergo plastic deformation, whereby safety devices such as the pressure gasket are required. Finally, the configuration of the anchoring means is such that a glass panel must be destroyed to be removed from the structural members. It is occasionally required to remove glass panels, for instance when moving large furniture. In such cases, removing a glass panel becomes a costly solution.

SUMMARY OF INVENTION

Therefore, it is a feature of the present invention to provide a novel curtain wall system.

It is a further feature of the present invention to provide a curtain wall system in which connection devices automatically lock the glazing panel to a frame of structural members upon positioning the glazing panel within the frame of structural members.

It is a still further feature of the present invention to provide a novel method for installing a glazing panel to a frame of structural members in a curtain wall system.

It is a still further feature of the present invention to provide a method for installing a glazing panel to a frame of structural members in a curtain wall system in which the glazing panel is automatically locked to a frame of structural members upon positioning the glazing panel within the frame of structural members.

Therefore, in accordance with the present invention, there is provided a connector device for a curtain wall system of the type having structural members secured to the building framing to define frames to support glazing panels, the glazing panels each having a sash by which the glazing panels are secured to the frames of structural members to form an outer wall portion of a building, the curtain wall system having at least one connector device securing one of the glazing panels to one of the frames of structural members, the connector device comprising a keeper secured to any one of the frame and the sash, and a latch mechanism secured opposite the keeper on the other of the frame and the sash, the latch mechanism having a latch bolt automatically displaceable to a locking position upon contact with the keeper, the keeper and the latch mechanism cooperating in said locking position to lock the glazing panel to the frame in a secured position.

Further in accordance with the present invention, there is provided a method for installing a curtain wall portion to a building frame, comprising the steps of: i) providing structural members; ii) providing glazing panels and positioning second connection members on a sash of the glazing panels; iii) installing the structural members to a building framing so as to define frames adapted to support glazing panels; iv) automatically securing the glazing panels to frames by inserting the glazing panels within the frames, whereby the first connection members and the second connection members cooperate to lock the glazing panels to the frames; and v) forcing the second members into a blocked position.

Still further in accordance with the present invention, there is provided a curtain wall system comprising structural members secured to the building framing to define frames, glazing panels each having a sash by which the glazing panels are secured to the frames of structural members to form an outer wall of a building, and connector devices securing the glazing panels to the frames of structural members, the connector device having a keeper secured to any one of the frame and the sash of the glazing panel, a latch mechanism secured opposite the keeper on the other of the frame and the sash, the latch mechanism having a latch bolt automatically displaceable to a locking position upon contact with the keeper, the keeper and the latch mechanism cooperating in said locking position to lock the glazing panel to the frame in a secured position.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
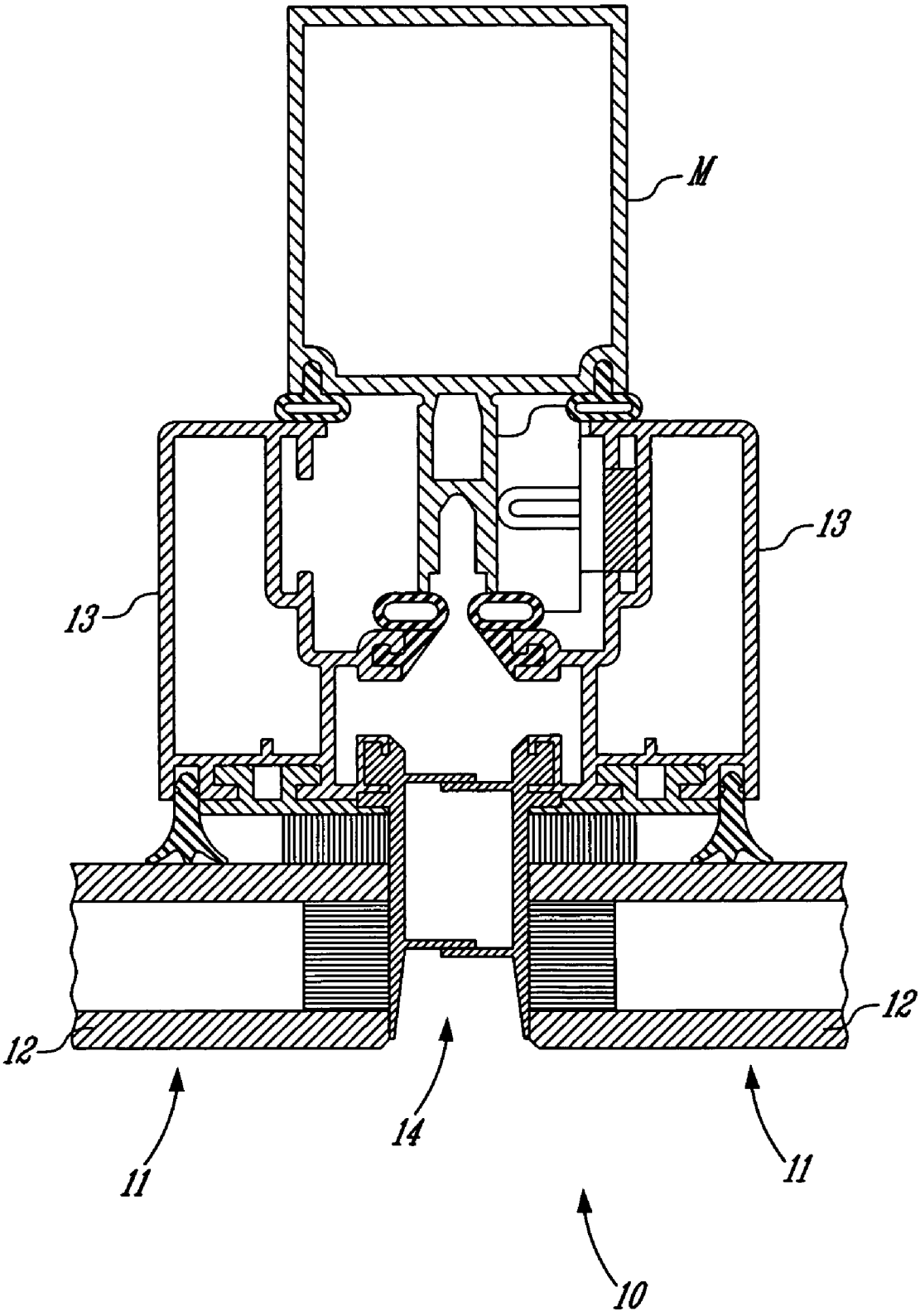
FIG. 1 (PRIOR ART)
FIG. 1 is a cross-sectional top view of a curtain wall system in accordance with the prior art.

Referring to the drawings and, more particularly, to FIG. 1, a curtain wall system in accordance with the prior art is generally shown at 10. The curtain wall system 10 is part of a VEC facade. Accordingly, each glazing panel 11 has a glass panel 12 and sash members 13 projecting away from a rear surface of the glass panel 12. The sash members 13 are provided so as to secure the glazing panel 11 to the mullions M (one of which is shown in FIG. 1 and is also known as an upright) and transoms (i.e., crosspieces).

The sash members 13 are secured to a rear surface of the glass panel 12, whereby glass panels 12 of adjacent glazing panels 11, as shown in FIG. 1, are not separated by structural members as is the case with traditional curtain wall systems.

Adjacent glazing panels 11 are spaced by a gap 14, which gap 14 is partially blocked from water/air infiltration by gaskets 15. The sash members 13 and the mullion M are accessed through the gap 14. It is therefore through the gap 14 that fasteners, such as screws, bolts or the like, are inserted to secure the glazing panel to the mullions M, and transoms or other structural members of curtain walls.

Figure 2:
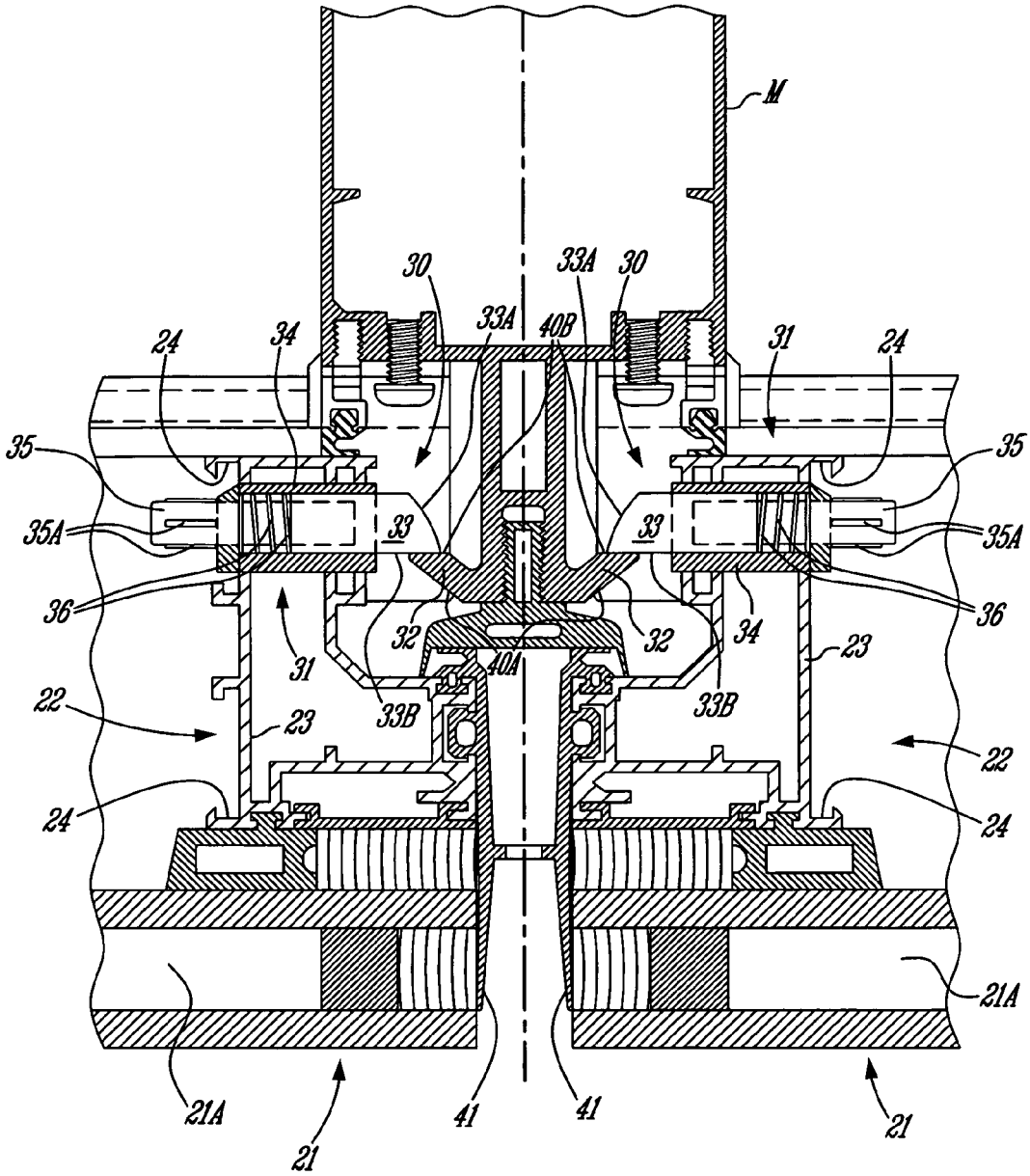
FIG. 2 is a cross-sectional top view of a curtain wall system in accordance with a preferred embodiment of the present invention.

Referring to FIG. 2, a curtain wall system in accordance with a preferred embodiment of the present invention is generally shown at 20. The curtain wall system 20 has glazing panels 21, each having a glass panel 21A (or translucent/transparent panel of like material). Sash members 22 form a polygonal frame (i.e., rectangular frame in most instances) that is secured to and projects from a rear surface of the glass panel. The sash of sash members 22 is used to secure the glazing panels 21 to the structural members about the periphery of the glazing panels 21, such as mullions M (one of which is shown in FIG. 1), and transoms.

Each of the sash members 22 is typically constructed of extruded members 23. The extruded members 23 define various channels, such as channel 24, to receive gaskets (not shown) or like sealing devices. Connection fingers 25 are also provided, whereby cover plates, such as cover plate 26 can cover the extruded members 23. This will be described in further detail hereinafter.

As mentioned previously, traditional glazing curtain wall systems involve the use of threaded fasteners or the like to secure the glazing panels to associated structural members. In order to simplify the interconnection between the glazing panel 21 and the structural members of the curtain wall system (e.g., mullion M), a connection device 30 is provided, as shown in FIGS. 2 and 3.

The connection device 30 uses cooperating connection members, such as a latch mechanism 31, and a keeper 32 formed in associated structural members. In a preferred embodiment of the present invention, as shown in FIG. 2, the latch mechanism 31 of the connection device 30 is secured to the sash members 22, whereas the keeper 32 is extruded with the structural members, such as the mullion M or transoms. Although not illustrated and described, it is also contemplated to position the latch mechanism 31 in the structural members with the keepers 32 in the sash members 22.

Figure 3:
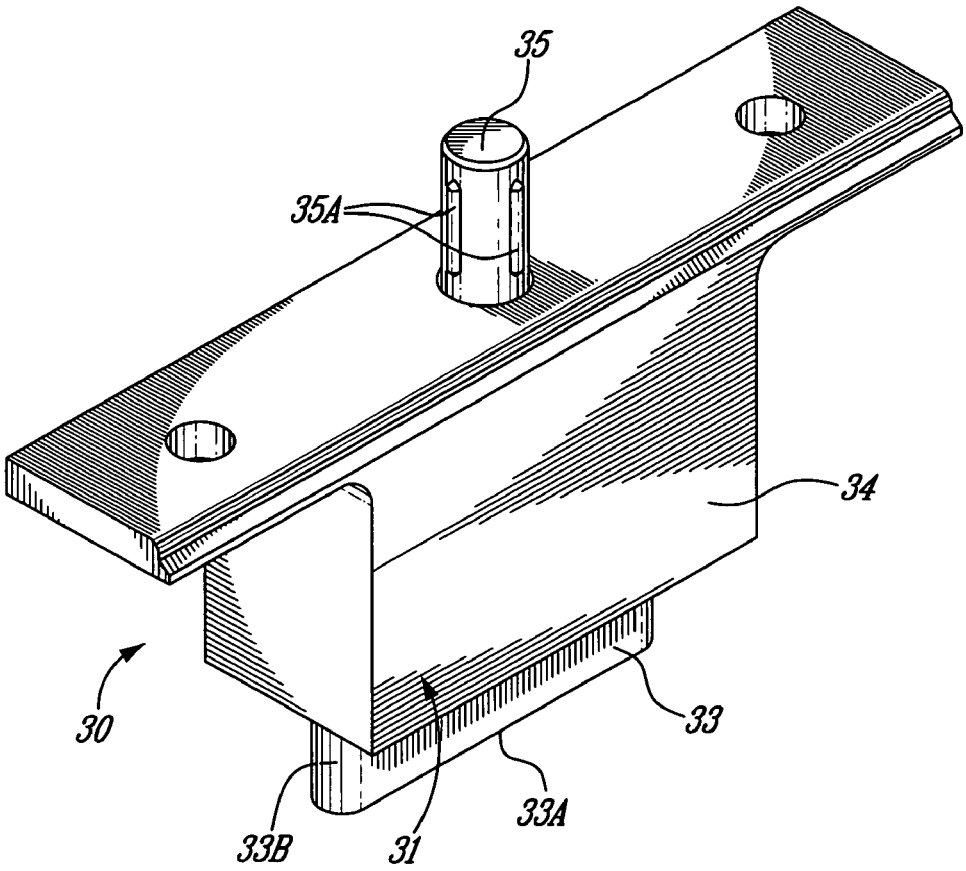
FIG. 3 is a perspective view of a connection device as used in the curtain wall system of FIG. 2.

Referring concurrently to FIGS. 2 and 3, the latch mechanism 31 has a latch bolt 33 in a casing 34. The latch bolt 33 has a ramp surface 33A and an abutment surface 33B. The casing 34 is tubular, and the latch bolt 33 is partially accommodated within the casing 34, and projects out of a first end of the casing 34. A pin having a pin head 35 projects away from latch bolt 33, such that the pin head 35 protrudes out of the second end of the casing 34. In the illustrated embodiment of FIG. 3, the pin is a bolt, and the pin head 35 has a plurality of longitudinal fins 35A.

A biasing member 36 (i.e., a spring) biases the latch bolt 33 to the projecting position illustrated in both FIGS. 2 and 3. The latch bolt 33 is retractable within the casing 34 against the force of the biasing member 36.

In FIG. 2, the keeper 32 is shown as an extruded projection of the mullion M. The keeper 32 has a protrusion 40 that will cooperate with the latch bolt 33 to secure the glazing panel 21 to the structural members. The protrusion 40 has a ramp surface 40A and an abutment surface 40B.

Now that the connection device 30 has been described, an installation of the glazing panel 21 using the connection device 30 is described.

Figure 4:
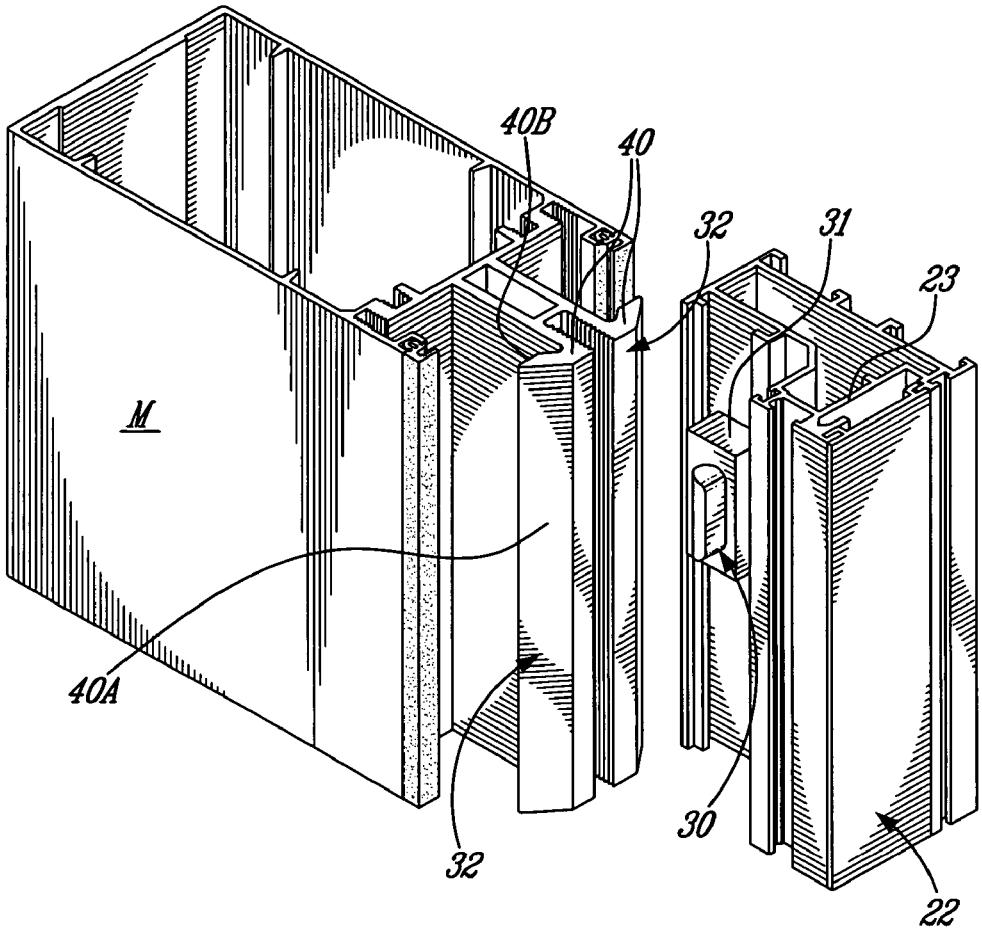
FIG. 4 is a perspective view illustrating a glazing panel in the process of being secured to a structural member for the curtain wall system of FIG. 2.
Figure 5:
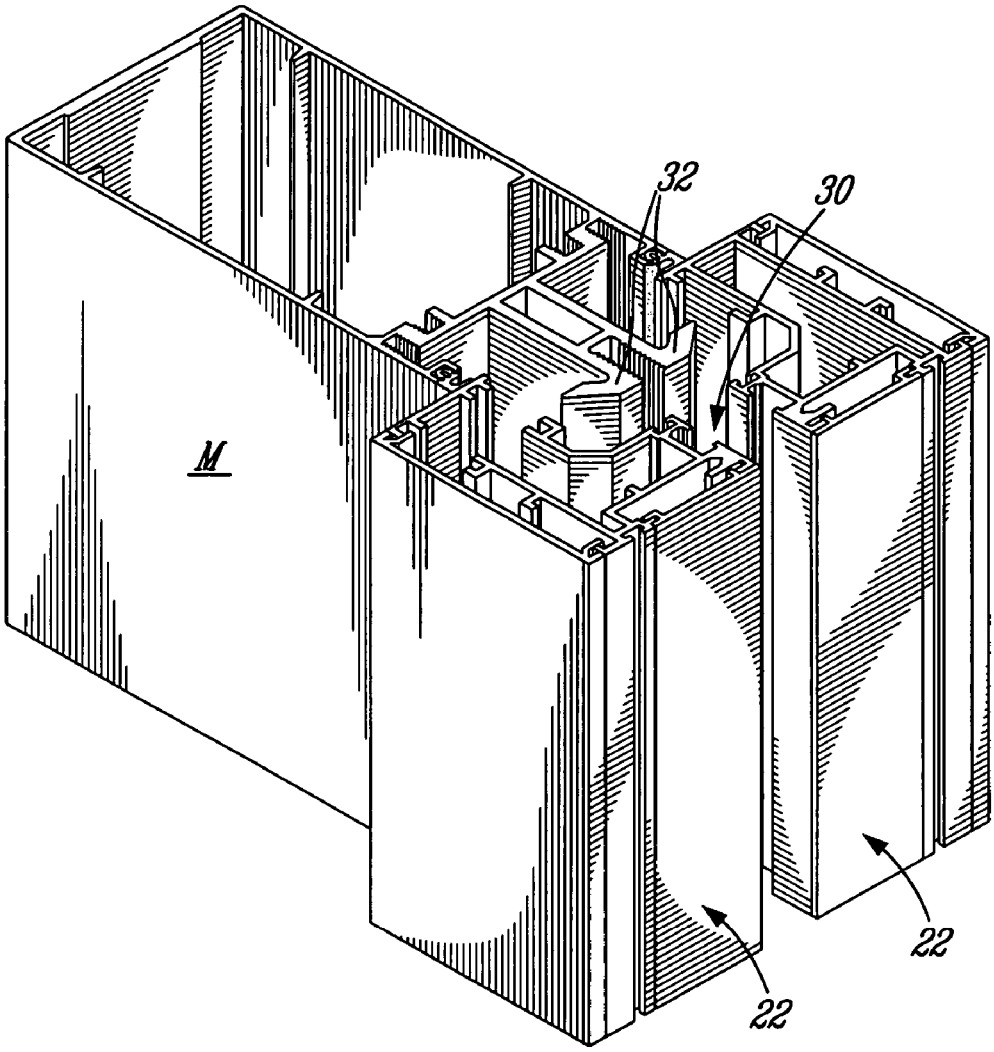
FIG. 5 is a perspective view illustrating the glazing panel secured to the structural member for the curtain wall system of FIG. 2.

Only one connection device 30 is visible from the illustrations of the curtain wall system 20 of FIGS. 2, 4 and 5 (with the glass panel removed from FIGS. 4 and 5 for the simplicity of the illustration). However, it is contemplated to provide a plurality of the connection device 30 about the periphery of the sash of sash members 22 and of the corresponding frame of structural members (i.e., mullions M and transoms). In doing so, a plurality of latch mechanisms 31 interact with the keepers 32.

Referring to FIG. 4, the glazing panel 21 is brought into a corresponding opening defined by the structural members (such as the mullion M), in a direction represented by A. When the latch bolt 33 comes into contact with its associated keeper 32, the latch bolt 33 retracts into the casing 34 by the action of the ramp surfaces 33A and 40A contacting each other.

When the glazing panel 21 is in position within the frame of structural members, the latch bolt 33 has been biased back to its projecting position, as illustrated in FIGS. 2 and 5. Accordingly, the abutment surfaces 33B and 40B are coplanar, such that the glazing panel 21 is locked to the structural members (e.g., the mullion M). The latch bolt 33 is further engaged into connection with the keeper 32, by forcing the fins 35A into the casing 34 (e.g., force fitting). This is preferably done by hammering on the head 35. Accordingly, a contact surface between the abutment surfaces 33B and 40B is increased, while an interference engagement is caused between the head 35 and the casing 34, whereby the latch bolt 31 is blocked in the locking position.

Various seals or gaskets are provided against water/air infiltration through the curtain wall system 20. One of these gaskets is generally shown at 41, and is squeezed between the sash member 22 and the mullion M. Although only one gasket is illustrated for clarity of the illustrations, it is pointed out that a plurality of gaskets are typically used with the curtain wall system 20.

Therefore, the curtain wall system 20 of the preferred embodiment of the present invention facilitates the installation of glazing panels 21 to the structural members, in that the connection devices 30 clip the glazing panel 21 into secured position within the frame formed of structural members. It is contemplated to provide a plurality of the connection devices 30, such that no other types of fasteners are required in securing the glazing panel 11 to the frame of structural members. Alternatively, a combination of the connection device 30 and threaded fasteners can be used.

In order to remove the glazing panel 21 from the frame of structural members, the latch bolt 33 is retracted within the casing 34 until the abutment surfaces 33B and 40B no longer interfere with one another. The latch bolt 33 is retracted within the casing 34 by pulling onto the pin head 35. In instances in which a plurality of connection devices 30 are provided to secure the glazing panel 21 to the frame of structural members, it is contemplated to provide a wedge (not shown) that will keep the latch bolt 31 retracted in the casing 34.

It is pointed out that the pin heads 35 are oriented toward an interior of the building. Accordingly, the connection devices 30 are unlocked from an interior of the building.

Figure 6:
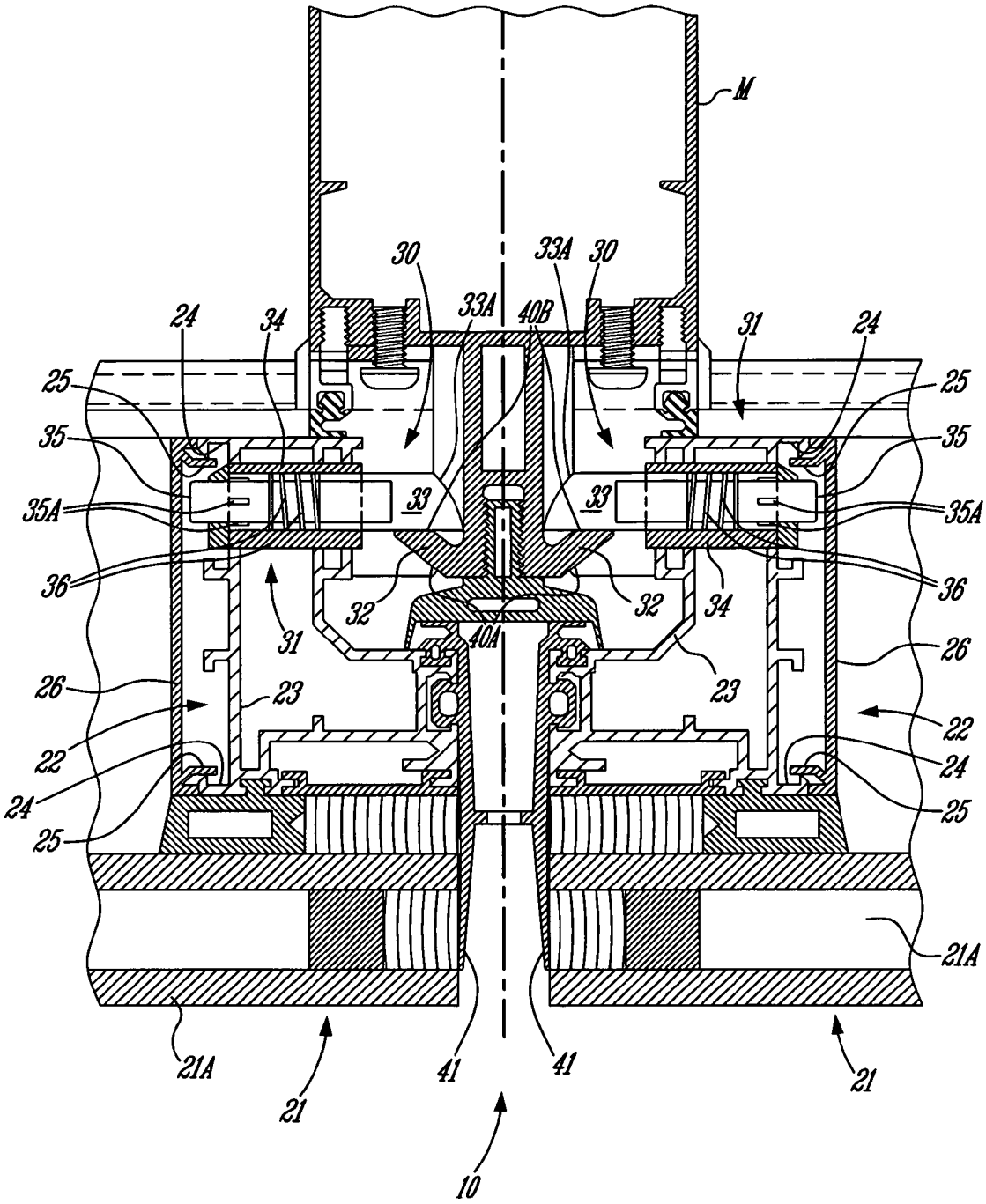
FIG. 6 is a cross-sectional top view of the curtain wall system of FIG. 2, with a latch bolt in forced engagement with the structural member.

Referring to FIG. 6, it is seen that very little clearance is provided between the pin head 35 and the cover plate 26. Accordingly, if the latch bolt 33 is not in its projecting position (as illustrated in FIGS. 2 and 3), the pin head 35 will prevent the cover plate 26 from being installed, and this can be interpreted as an indication that the glazing panel 21 is not fully secured to the frame of structural members. The latch bolts 33 must therefore be hammered into forced engagement with the keeper 32, as described above, for the cover plate 26 to be installed.

The amount of installation time for the curtain wall system 20 is therefore relatively low. For instance, workers do not need to maintain the glazing panel against the frame of structural members, as the connection devices 30 will automatically lock the glazing panel 21 into position in the frame of structural members. Also, as fasteners no longer need to be inserted between adjacent glazing panels in some instances, the gap between adjacent glazing panels can be reduced. This results in an enhanced esthetic appeal to the curtain wall system 20. Moreover, the release member constituted by the pin head 35 enables the removal of a glazing panel from a frame of structural members. It is also contemplated to provide set screws or similar equipment on the sash of sash members 22, to allow an adjustment of the position of the glazing panel 21 with respect to the frame of structural members. This adjustment is performed once the glazing panel 21 has been engaged into the frame of structural members.

It is within the ambit of the present invention to cover any obvious modifications of the embodiments described herein, provided such modifications fall within the scope of the appended claims.

The invention claimed is:

1. A method for installing a curtain wall portion to a building frame, comprising the steps of:

i) providing structural members with first connection members;

ii) providing glazing panels and positioning second connection members on a sash of the glazing panels, the second connection members each having a biased latch bolt, a spring biasing the latch bolt in a first direction, the latch bolt having a ramp surface;

iii) installing the structural members to a building framing so as to define frames adapted to support glazing panels;

iv) automatically latching the glazing panels to frames by inserting the glazing panels within the frames along an axis generally normal to the frames, whereby the latch bolts of the second connection members move to a retracted position opposite the first direction upon contacting the ramp surface with the first connection member and back to a projecting position after the ramp surface passes the first connection members to lock the glazing panels to the frames; and v) forcing the latch bolts of the second connection members into a blocked position.

2. The method according to claim 1, wherein providing structural members and providing glazing panels are effected off the construction site.

3. The method according to claim 1, further comprising a step of vi) removing a glazing panel from a frame by actuating a release member on any one of the first connection member and the second connection member and pulling the glazing panel away from the frame.

4. The method according to claim 1, wherein v) forcing the second connection members comprises force fitting the second connection members to a structure of the glazing panels.

* * * * *